US007828505B2

(12) United States Patent
Sakada et al.

(10) Patent No.: US 7,828,505 B2
(45) Date of Patent: Nov. 9, 2010

(54) LOADING DEVICE FOR WORKING MACHINE

(75) Inventors: Seiji Sakada, Chikugo (JP); Makiko Tajima, Chikugo (JP); Kouichi Takata, Chikugo (JP); Yousuke Yamashita, Chikugo (JP)

(73) Assignee: Yanmar Co., Ltd., Osaka-shi, Osaka (JP)

( * ) Notice: Subject to any disclaimer, the term of this patent is extended or adjusted under 35 U.S.C. 154(b) by 133 days.

(21) Appl. No.: 11/909,037

(22) PCT Filed: Jan. 23, 2006

(86) PCT No.: PCT/JP2006/300953

§ 371 (c)(1),
(2), (4) Date: Nov. 2, 2007

(87) PCT Pub. No.: WO2006/100823

PCT Pub. Date: Sep. 28, 2006

(65) Prior Publication Data

US 2008/0193269 A1 Aug. 14, 2008

(30) Foreign Application Priority Data

Mar. 18, 2005 (JP) ..... 2005-080678

(51) Int. Cl.
*E02F 3/38* (2006.01)

(52) U.S. Cl. ..... 414/722; 414/686

(58) Field of Classification Search ..... 414/680, 414/686, 722; 180/785; 280/796, 785; 296/30
See application file for complete search history.

(56) References Cited

U.S. PATENT DOCUMENTS 1,893,721 A * 1/1933 Wahlberg ..... 280/796

(Continued)

FOREIGN PATENT DOCUMENTS

JP 7-14439 4/1995

(Continued)

OTHER PUBLICATIONS

International Search Report for International Application No. PCT/JP2006/300953, Japanese Patent Office, mailed Apr. 11, 2006, 2 pgs.

*Primary Examiner*—Donald Underwood
(74) *Attorney, Agent, or Firm*—Sterne, Kessler, Goldstein & Fox P.L.L.C.

(57) ABSTRACT

A lift arm having a plate-like structure that is capable of taking a large load is realized without increasing a plate thickness and at low cost. The structure with required strength and of low cost is realized by a simple construction and achieves, at the same time, both weight lightening of a loader and sufficient load bearing performance. In a loader (2) of a working machine (1), connection sections between a cross member (176) and lift arms (171) are each formed in a shape broadening from the cross member (176) toward a lift arm (171). Further, reinforcement plates are attached to outer surfaces of a front loader (2) so as to overlap the connection sections between the cross member (176) and the lift arms (171). Contact members (**171*b*, 171*b*) are attached to lower side faces at the heads of the lift arms (171) to restrict the amount of rotation of a working device installed on the heads of the lift arms (171**).

3 Claims, 12 Drawing Sheets

U.S. PATENT DOCUMENTS

| | | | | |
|---|---|---|---|---|
| 5,535,533 | A * | 7/1996 | Romanchok | 37/403 |
| 6,309,171 | B1 * | 10/2001 | Arck et al. | 414/706 |
| 6,461,099 | B1 * | 10/2002 | Gosz | 414/701 |
| 2005/0045351 | A1 * | 3/2005 | O'Brien et al. | 172/810 |

FOREIGN PATENT DOCUMENTS

| | | |
|---|---|---|
| JP | 11-229424 | 8/1999 |
| JP | 2003-278179 | 10/2003 |
| JP | 2005-16022 | 1/2005 |

* cited by examiner (a)

(b)

(a)

(b)

(a)

(b)

LOADING DEVICE FOR WORKING MACHINE

TECHNICAL FIELD

The present invention relates to a loading device (loader) installed in a working machine for loading the earth and sand.

BACKGROUND ART

In general, the loading device such as a front loader and the like installed in the working vehicles comprises a pair of left and right lift arms, a bucket attached to heads of the lift arms, cylinders for lifting the lift arms, and cylinders for rotating the bucket. The front loader is attached to brackets installed in the both sides of a bonnet of a tractor that is one of the working vehicles. The cylinders for lifting the lift arms are installed at a lower side of the lift arm of the front loader, and a link for the bucket is installed at an upper side of the lift arm. The link is connected to the cylinder for swinging the bucket through an intermediate link attached to the above-mentioned bracket and to the upper portion of the lift arm. The telescopic motion of the cylinder swings the bucket.

Conventionally, with respect to structures of such a front loader, Japanese Patent Laying-Open No. 2005-16022 discloses that a box-shaped lift arm is used for lifting the loader in order to secure its own strength.

However, in the conventional box-shaped lift arm, four plates are needed to form the box-shape, and the length of welds for joining the plates are long, and this causes an increase in cost. When the lift arm has a plate-like structure, it is necessary to increase the plate thickness in order to take a large load, which increases the weight of the working machine and increases costs in correspondence to the increase of weight.

DISCLOSURE OF THE INVENTION

Object

An object of the present invention is to realize a structure with required strength and low cost and to achieve, at the same time, both weight-lightening of a loader and sufficient load bearing performance.

Solution

The present invention solves the problem by means as follows: The present invention provides a loading device installed in a working machine. In the loading device, lift arms extended in longitudinal direction are connected to each other by a cross member, and connection sections between inner surfaces of the lift arms and the cross member are each formed in a shape broadening from the cross member toward the lift arm.

In the above mentioned loading device, reinforcement members are each attached to an outer surface of each of the lift arms so as to overlap a connection section between the cross member and the lift arm in a side view.

Preferably, contact members are attached to lower side faces of heads of the respective lift arms, so as to restrict an amount of rotation of a working apparatus installed on the heads of the lift arms.

Effects of the Invention

According to the present invention, as shown in the preferable embodiment, stress concentration at connection sections can be prevented, so that a durability of the loader can be improved.

According to the present invention, an increase in the weight of the lift arms can be prevented and, at the same time, a rigidity of the lift arms can be improved.

According to the present invention, contact pressure when dumping can be reduced, so that a durability of the loader can be improved.

EXPLANATION OF REFERENCE NUMERALS

2 loader
171 lift arm
171*b* stopper
176 first cross member
176*b* base
179 reinforcement plate

BEST MODE FOR CARRYING OUT THE INVENTION

In the present invention, a link mechanism for lifting and swinging a loading device installed in a working machine is simply configured and the weight of the link mechanism is lightened by means of using a plate-like member, and the link mechanism is reinforced at an important point in order to improve its load capacity.

Embodiment 1

Overall Structure

Figure 1:
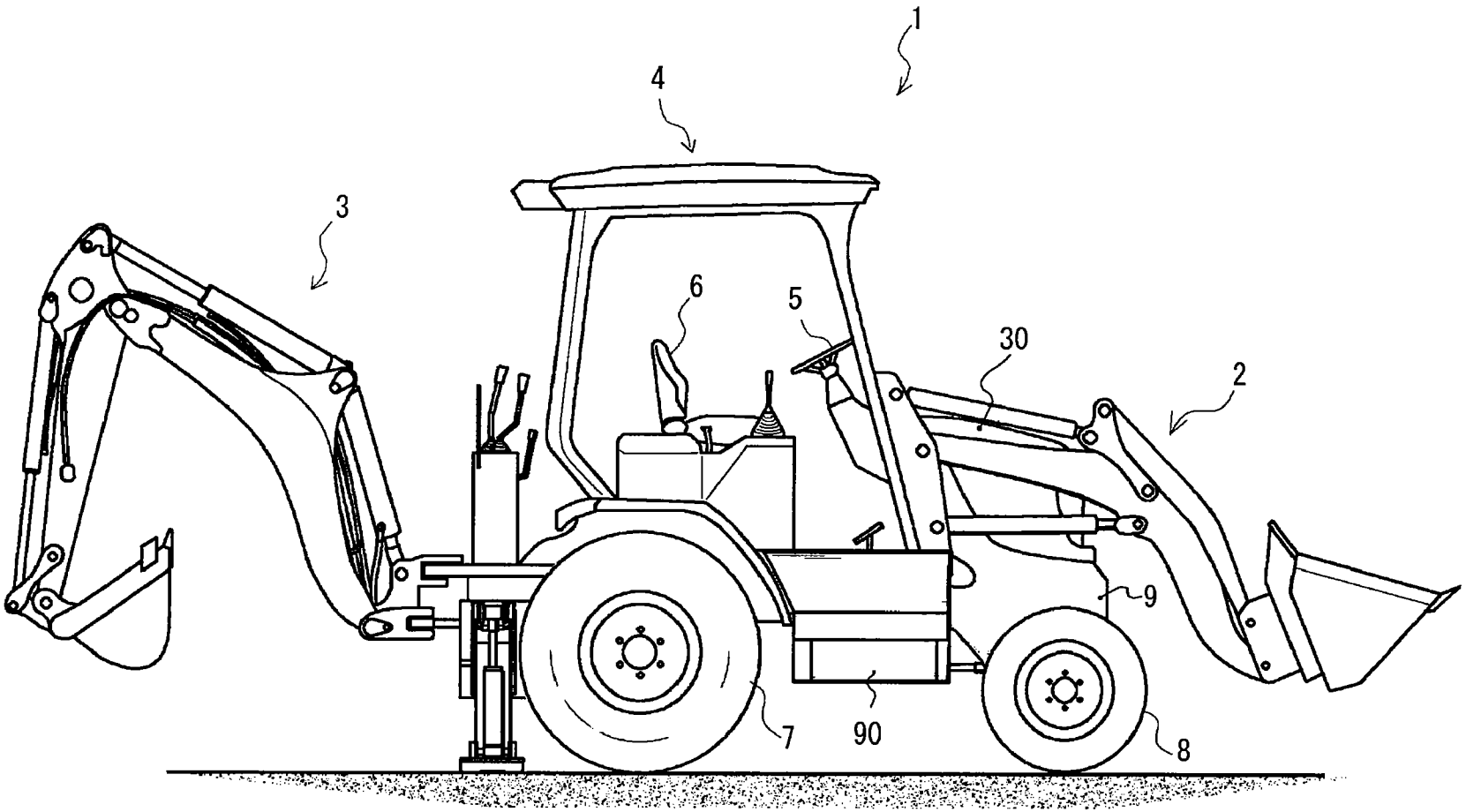
FIG. 1 is a side view of a working vehicle.

An embodiment of the present invention will be described. FIG. 1 is a side view of an entire working vehicle. A working vehicle 1 shown in FIG. 1 is a tractor loader backhoe, equipped with a loader 2 and a digger apparatus 3. A steering part 4 is provided at a center portion of the vehicle 1, and the loader 2 is provided in front of the steering part 4, and the digger apparatus 3 is provided in a rear of the steering part 4. The vehicle 1 is equipped with front wheels 7 and rear wheels 8 so that the vehicle 1 with the loader 2 and the digger apparatus 3 can drive.

A steering wheel 5 and a seat 6 are provided in the steering part 4, and an operation apparatus for driving direction and an operation apparatus for the loader 2 are provided at the side of the seat 6. Thus, a driving direction of the vehicle 1 and the loader 2 can be operated at the steering part 4. The loader 2 that is one of the loading devices is connected to side portions of the vehicle 1 and extended forward, and a bucket is provided at a head of the loader. An engine is provided at a front portion of a frame 9 that is a chassis of the vehicle 1, and the engine is covered in a bonnet 30 provided on the frame 9.

The loader 2 is provided outside the bonnet 30. The digger apparatus 3 is detachably attached to a rear portion of the vehicle 1, and the digger apparatus 3 is operated by an operation apparatus provided in a rear of the seat 6. A hydraulic oil tank 90 is provided beside the seat 6, and is formed on a portion thereof opposite to the steering part 4 with steps for getting on and off the steering part 4. The hydraulic oil tank 90 is a reservoir tank of hydraulic oil.

The loader 2 is provided at a front portion of the vehicle 1 through a mast member, and works as a front loader. The front wheels 8 are provided below lift arms of the loader 2 so as to serve as steerable wheels of the vehicle. The lift arms are bent upward at center portions thereof so as to ensure enough space to allow turn of the steerable wheels below the lift arms.

[Structure of Loader]

A construction of the loader 2 will be described below referring to the drawings.

Figure 2:
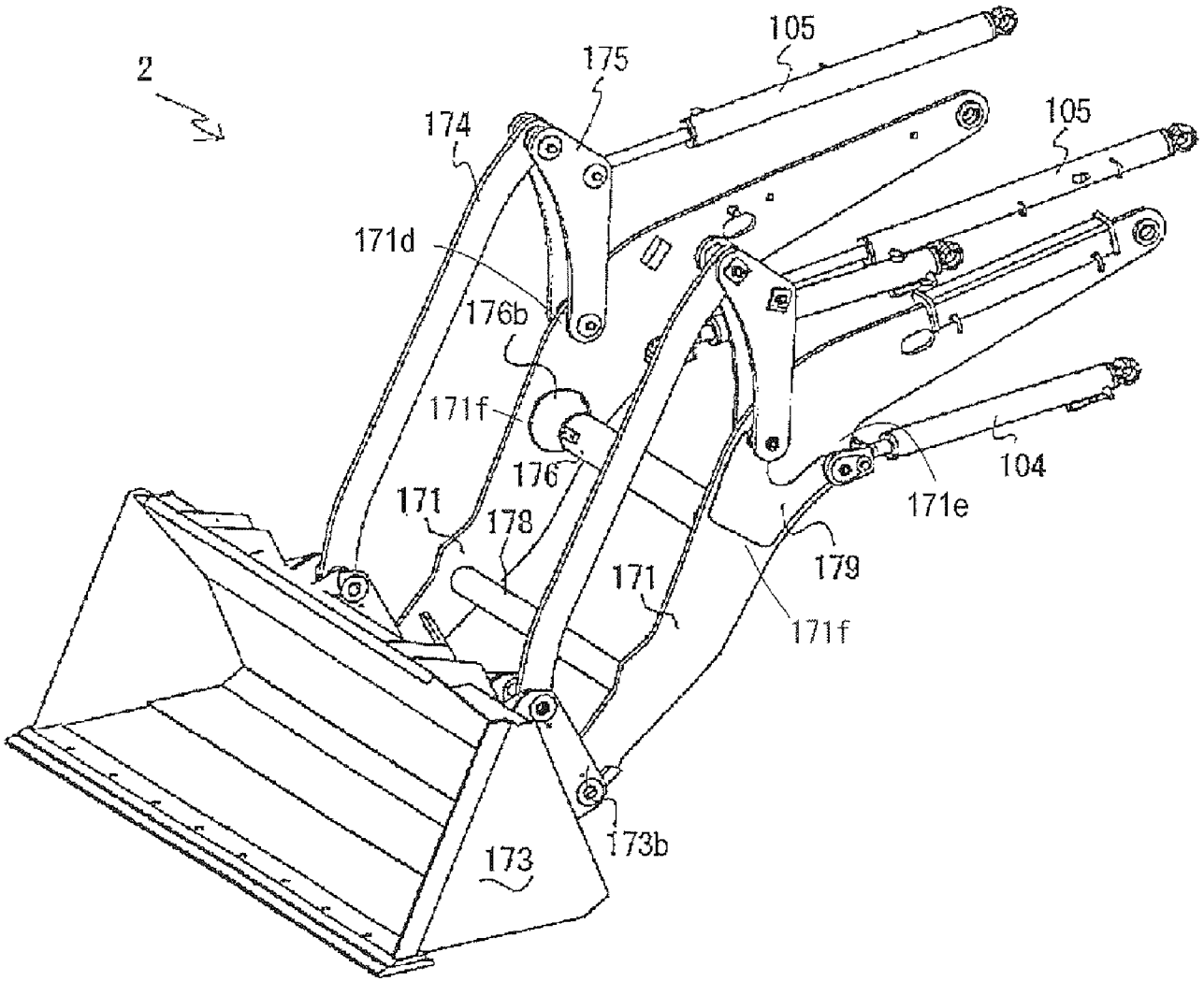
FIG. 2 is a perspective view of a loader.
Figure 3:
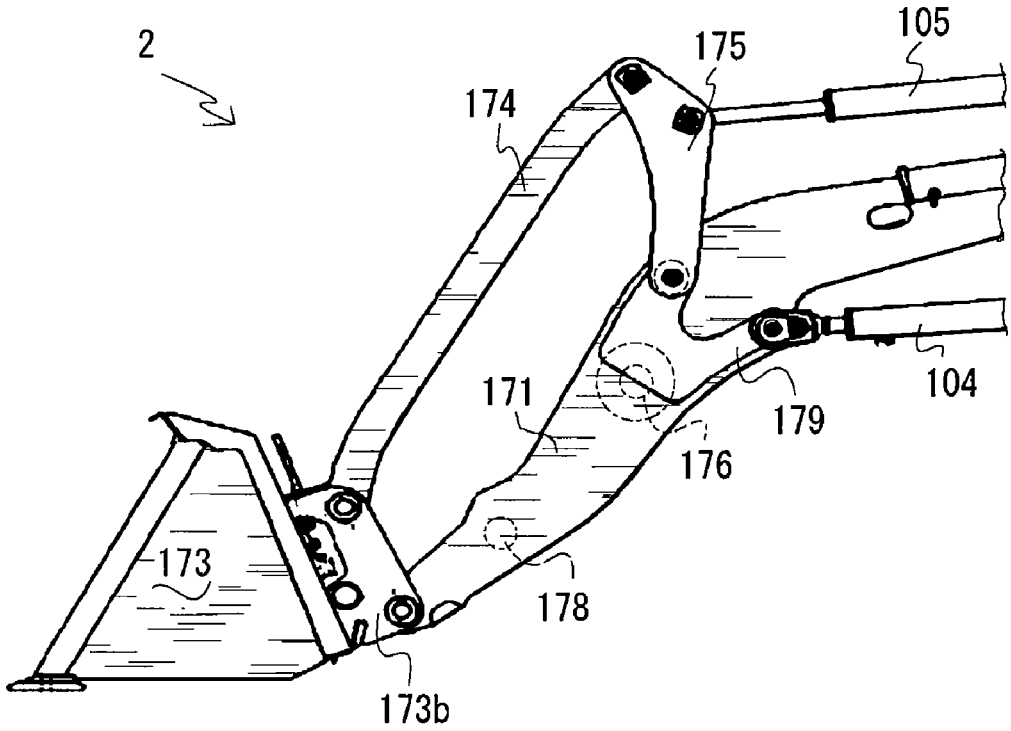
FIG. 3 is a partial side view of the loader.

FIG. 2 is a perspective view illustrating a loader. FIG. 3 is a partial side view illustrating a loader.

The loader 2 comprises lift arms 171, lift arm cylinders 104, a bucket 173, bucket links 174, intermediate links 175, bucket cylinders 105, a first cross member 176, and a second cross member 178. The lift arm 171, the lift arm cylinder 104, and the bucket cylinder 105 are pivoted at rear ends thereof onto the above-mentioned mast member of the frame 9.

The lift arms 171 are rotated upward and downward by the respective lift arm cylinders 104. The bucket 173 is swingably attached to front ends of the lift arms 171. The bucket 173 is connected to front ends of the bucket links 174 so as to be swung by the bucket cylinders 105 through the intermediate links 175.

The lift arms 171 are provided at respective left and right sides of the vehicle 1. The lift arms 171 are extended forwardly downward slantwise, and bent further downward at the respective center parts thereof, and bent forward at lower front portions thereof, that is, each of the lift arms has an approximately S-like shape. The bucket 173 is attached to heads of the lift arms 171 through attachments 173*b*. The bucket cylinder 105 and the bucket links 174 are provided above the lift arms 171. The intermediate links 175 are fore-and-aft rotatably provided on the respective lift arms 171. The lift arm cylinder 104 is provided below a center portion of the lift arm 171.

The first cross member 176 and the second cross member 178, which are the reinforcement members, are attached between the lift arms 171 in a transverse direction. The first cross member 176 is connected at both ends thereof to the left and right lift arms 171 through bases 176*b*. The first cross member 176 and the second cross member 178 are configured as pipes, and welded to the lift arms 171. Each of the lift arms 171 has a wide portion to be attached to the second cross member 178. The bucket 173 is detachably attached at a rear end thereof to the attachment 173*b*.

Each of the intermediate links 175 is pivoted at a lower end thereof to a longitudinally middle portion of the corresponding lift arm 171. The intermediate link 175 is pivoted at an upper rear portion thereof to a rear end of the bucket link 174, and pivoted at an upper rear portion thereof to a head of a rod of the bucket cylinder 105. The intermediate link 175 includes a pair of substantially triangular plates. The rear end of the bucket link 174, the bucket cylinder 105, and the lift arm 171 are provided between the two plates of the intermediate link 175 so as to be connected to the intermediate link 175. In this way, the bucket links 174 are disposed in the respective intermediate links 175 so as to be offset from the respective lift arms 171.

[Reinforcing Structure of Connection Sections of Intermediate Links]

Figure 4:
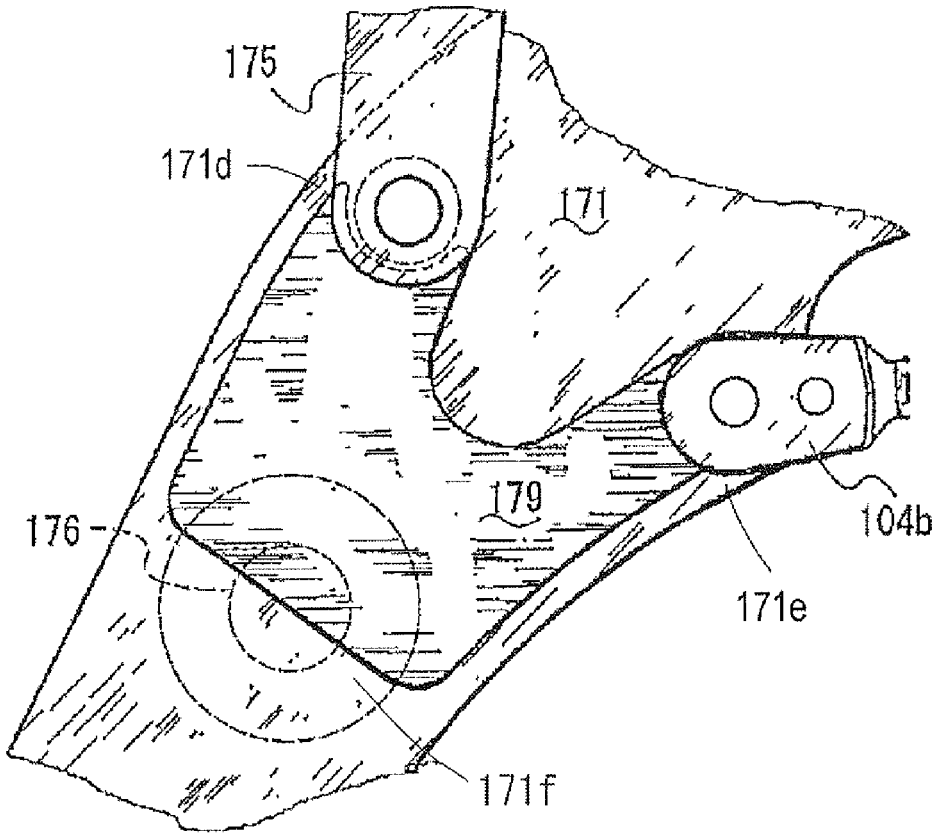
FIG. 4 is a side view illustrating an installation construction of reinforcement plates installed in lift arms.

A construction for reinforcing connection sections of the intermediate links of the loader 2 will be described below referring to the drawings. FIG. 4 is a side view illustrating an attachment construction of reinforcement plates attached to lift arms.

Reinforcement plates 179 are attached onto the center portions of the respective lift arms 171. Each of the reinforcement plates 179 connects a support section 171*d* of the lift arm 171 supporting the intermediate link 175 (hereinafter, referred to as intermediate link support section 171*d*) and a support section 171*e* of the lift arm 171 supporting the lift arm cylinder 104 (hereinafter, referred to as lift arm cylinder support section 171*e*), to each other. The reinforcement plate 179 is attached to an area of an outer side surface of the lift arm 171 inward from an outer edge of the side surface of the lift arm 171.

The reinforcement plate 179 is extended toward a head of the lift arm 171 from the intermediate link support section 171*d*. The reinforcement plate 179 is also extended toward the head of the lift arm 171 from the lift arm cylinder support section 171*e* connected to a rod 104*b* of the lift arm cylinder 104. The reinforcement plate 179 is spread so as to overlap a connection section of the first cross member 176, connected to a support section of the lift arm 171 supporting the first cross member 176 (hereinafter, referred to as cross member support section 171*f*), in a side view. In this embodiment, the reinforcement plate 179 overlaps a substantially half part of the first cross member 176. The reinforcement plate 179 is formed in an inclined V-like shape. On the lift arm 171, the reinforcement plate 179 connects the intermediate link support section 171*d*, the lift arm cylinder support section 171*e*, and the cross member support section 171*f* together. Thus, the lift arm 171 receives a dispersed stress from the intermediate link 175 and the lift arm cylinder 104, so as to be improved in a load bearing performance thereof. Since the reinforcement plate 179 is attached to the side surface of the lift arm 171, the lift arm 171 is reinforced and the reinforcement plate 179 is easily attached without interfering with the link mechanism of the loader 2.

In this way, the reinforcement plate 179 is attached to the outer surface of the lift arm 171 so as to overlap the connection section of the cross member 176 connected to the cross member support section 171*f* in the side view. As a result, a durability of the loader 2 is improved.

[Reinforcement of Cross Member]

A reinforcement construction of the first cross member will be described below.

Figure 5:
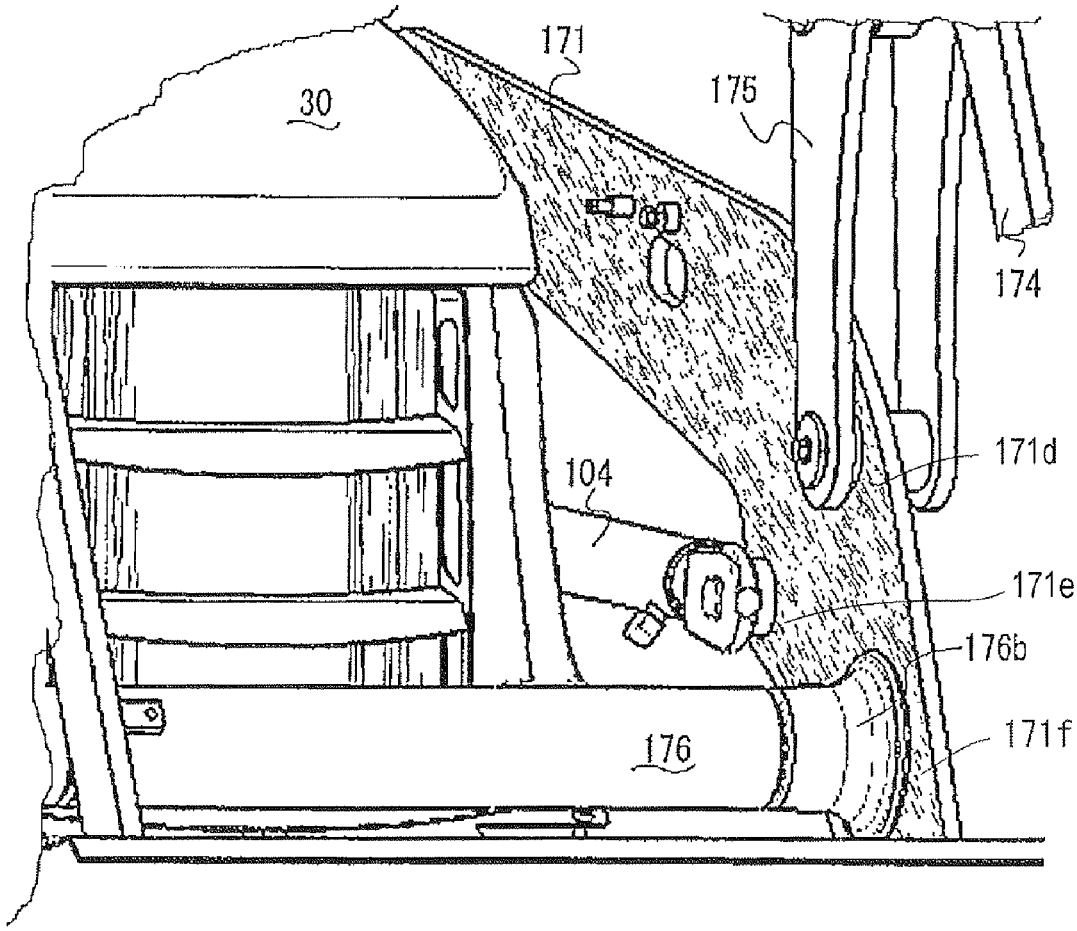
FIG. 5 is a perspective view illustrating connection sections of a first cross member.
Figure 6:
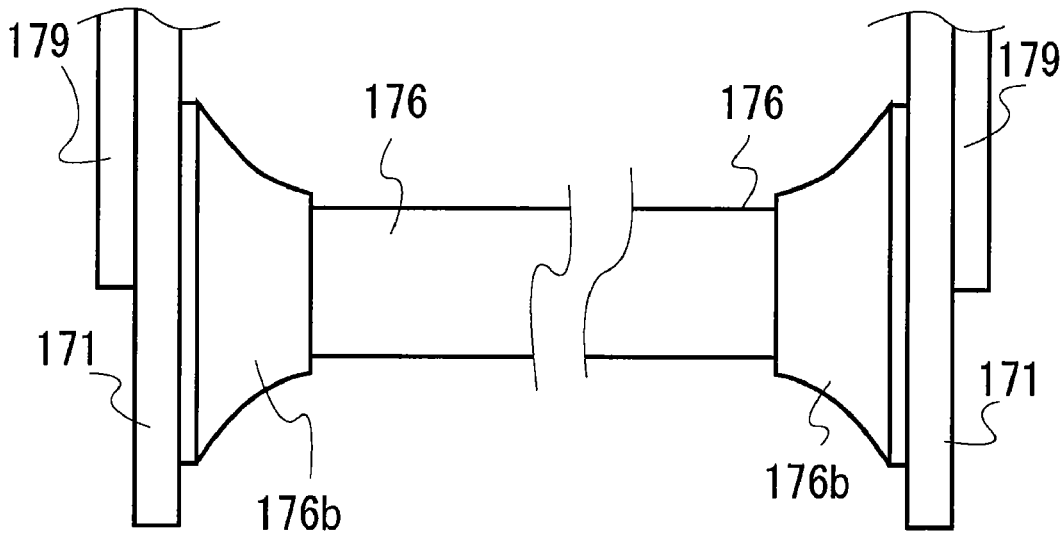
FIG. 6 is a schematic view illustrating a base of the first cross member.
Figure 6:
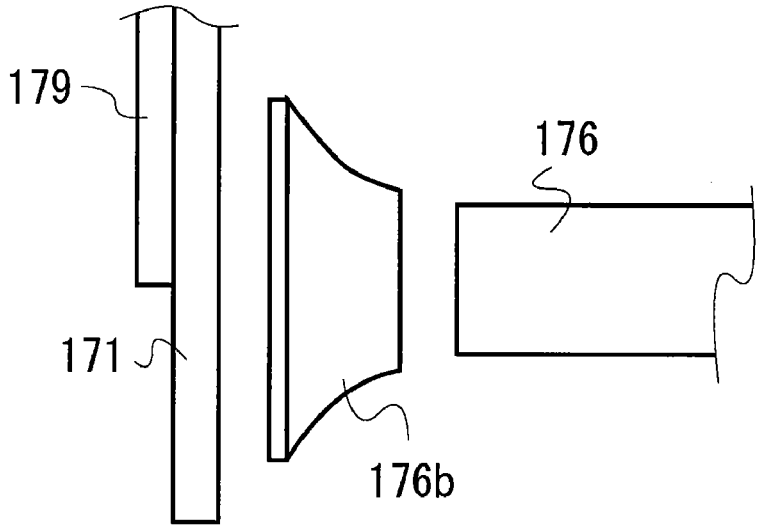
Figure 7:
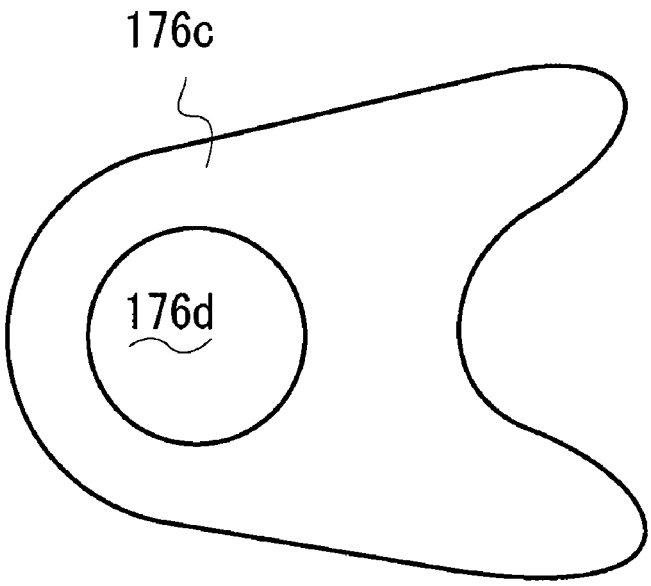
FIG. 7 is a schematic view illustrating a second base.
Figure 7:
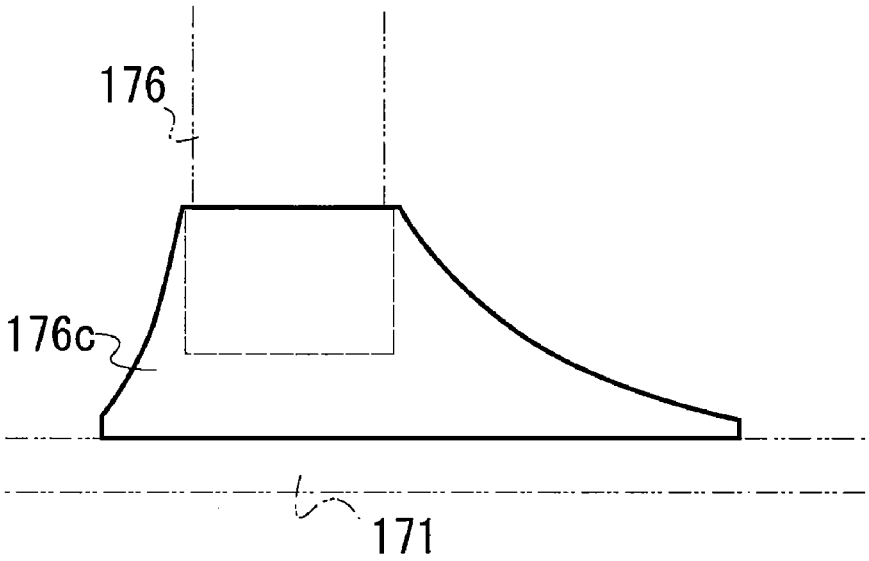
Figure 8:
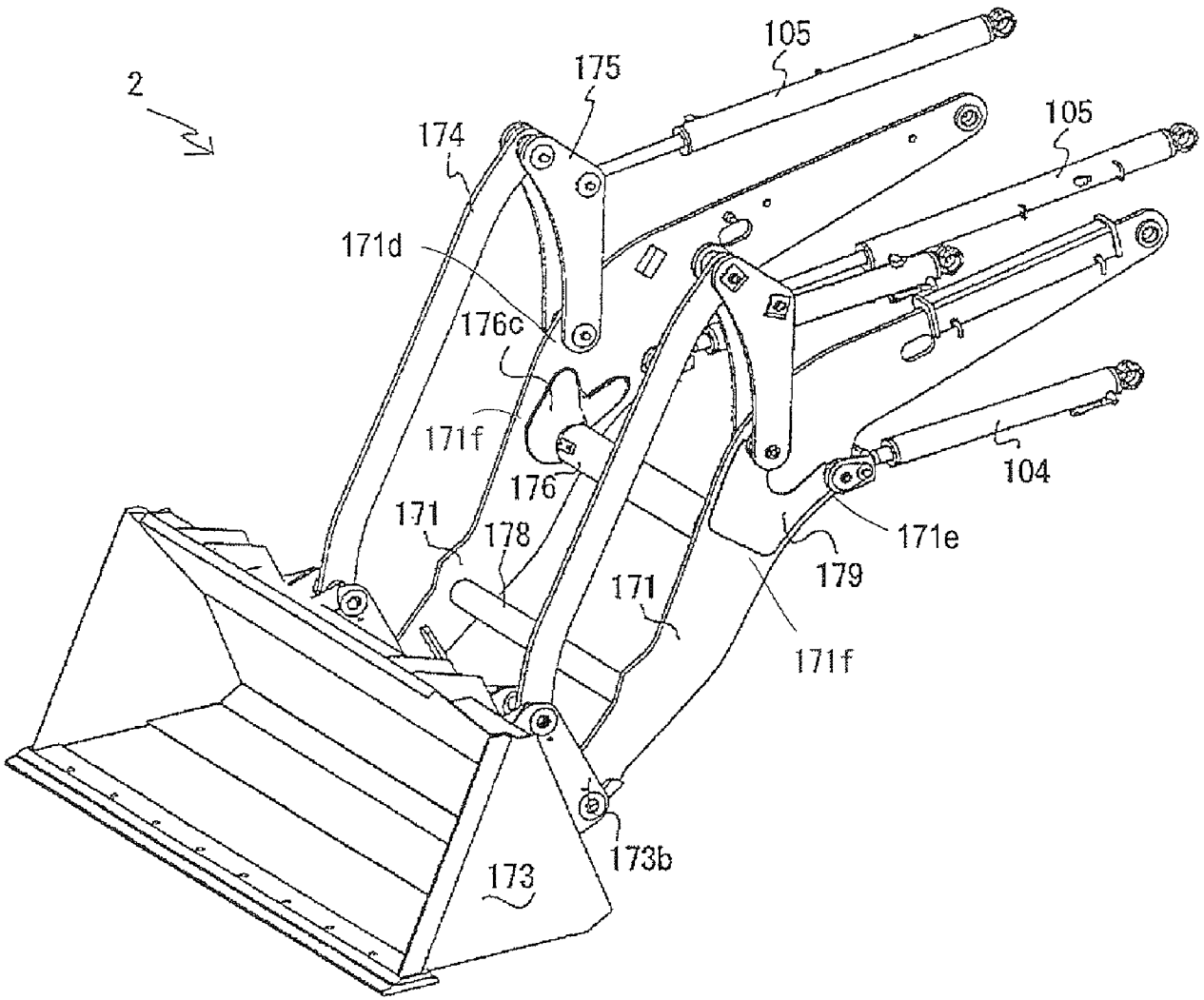
FIG. 8 is a perspective view illustrating another installation construction of the second base.

FIG. 5 is a perspective view illustrating a connection section of a first cross member. FIG. 6 illustrates a base of the first cross member. FIG. 6(*a*) is a front view illustrating a connection construction of the base. FIG. 6(*b*) is a front view illustrating construction of the base while being assembled. FIG. 7 is a schematic view illustrating a second base. FIG. 7(*a*) is a side view illustrating the second base. FIG. 7(*b*) is a front view illustrating the second base. FIG. 8 is a perspective view illustrating another attachment construction of the second base.

The first cross member 176 is connected to the lift arm 171 through the base 176*b*. The base 176*b* is substantially shaped in a cone gently depressed at a peripheral side surface thereof, as shown in FIG. 6. The base 176*b* is configured as a casting that can be welded. The base 176*b* is welded and fixed to the first cross member 176 and the lift arm 171. The base 176*b* can be fixed to the first cross member 176 by inserting an end of the first cross member 176 into the base 176*b*. The base 176*b* has a shape broadening toward the lift arm 171. Thus, a stress applied to the connection section between the first cross member 176 and each of the lift arms 171 is dispersed. A load bearing performance of the loader 2 is improved. Moreover, the first cross member 176 has large areas at the connection sections connected to the lift arms 171 so as to reduce the influence thereof obstructing the sight from the steering part 4.

In this way, the bases 176 serving as the connection sections between the first cross member 176 and the respective lift arms 171 are formed in shapes broadening from the first cross member 176 toward the respective lift arms 171. As a result, stress concentration on the connection sections can be prevented, so that the durability of the loader 2 can be improved.

The base 176*b* may be exchanged for a base as shown in FIGS. 7 and 8. Similar to the base 176*b*, a base 176*c* shown in FIGS. 7 and 8 has a fitting member 176*d* to be fitted to the first cross member 176, and has a shape broadening from the first cross member 176 toward the lift arm 171. The base 176*c* is partly extended toward the intermediate link support section 171*d* and the lift arm cylinder support section 171*e* in a top view. Thus, the stress applied to the intermediate link support section 171*d* and the lift arm cylinder support section 171*e* is dispersed, so that the rigidity of the loader 2 is improved. The base 176*c* can be configured by casting, which can easily achieve a complex shape with smooth curve and can decrease a manufacturing cost. Moreover, the base 176*c* is extended along the lift arm 171, so as to reduce the influence of the first cross member 176 obstructing a sight from the steering part 4.

[Dump Stopper for Loader]

Figure 9:
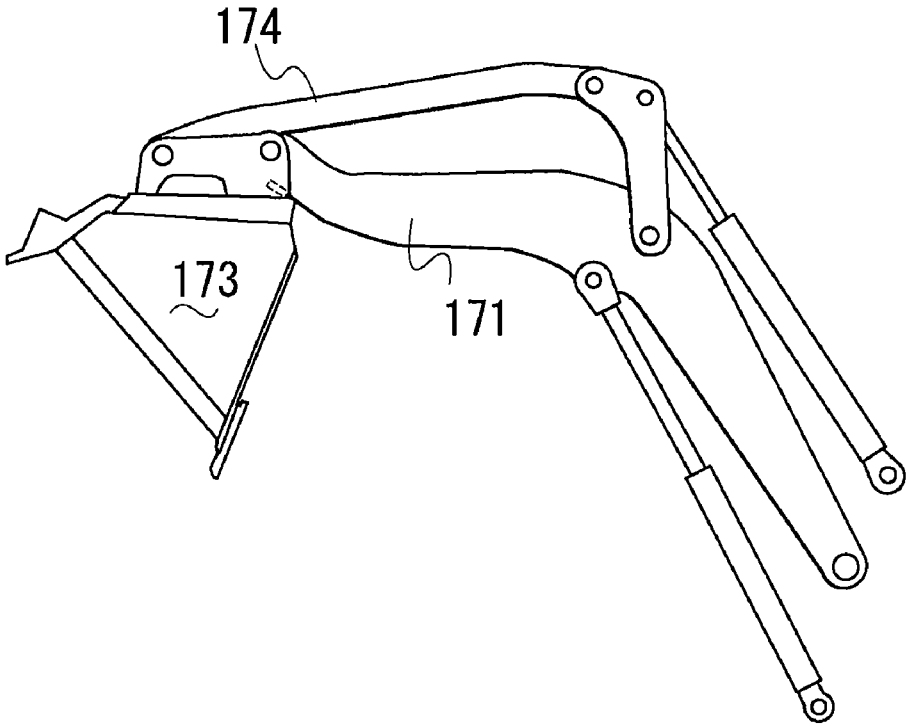
FIG. 9 is a schematic view illustrating a construction of a loader when dumping.
Figure 9:
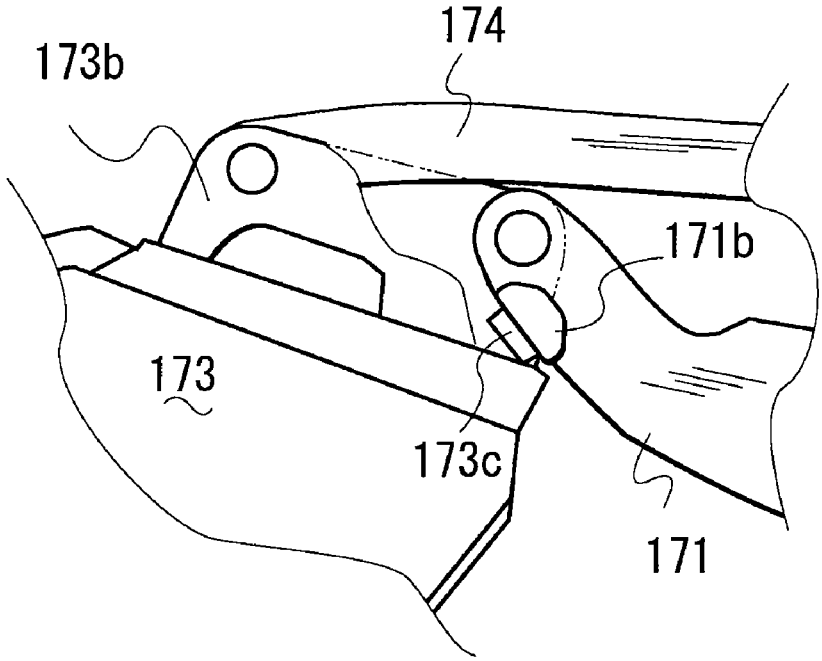
Figure 10:
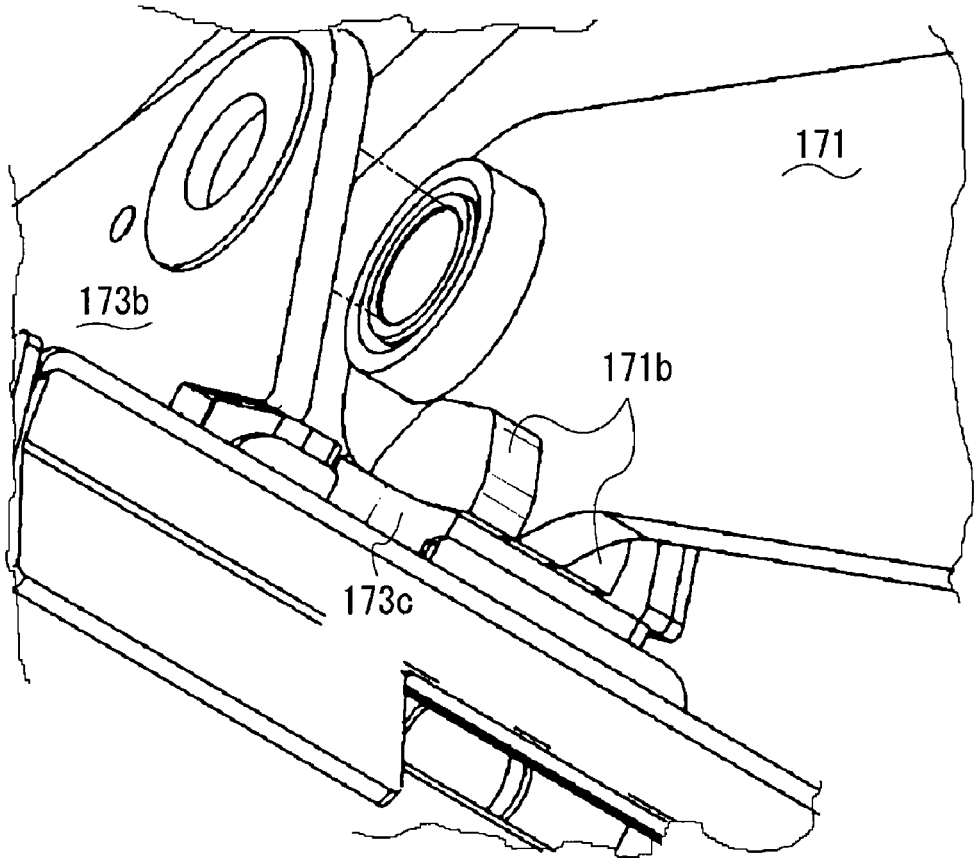
FIG. 10 is a perspective view illustrating a contact situation of a stopper when dumping.
Figure 11:
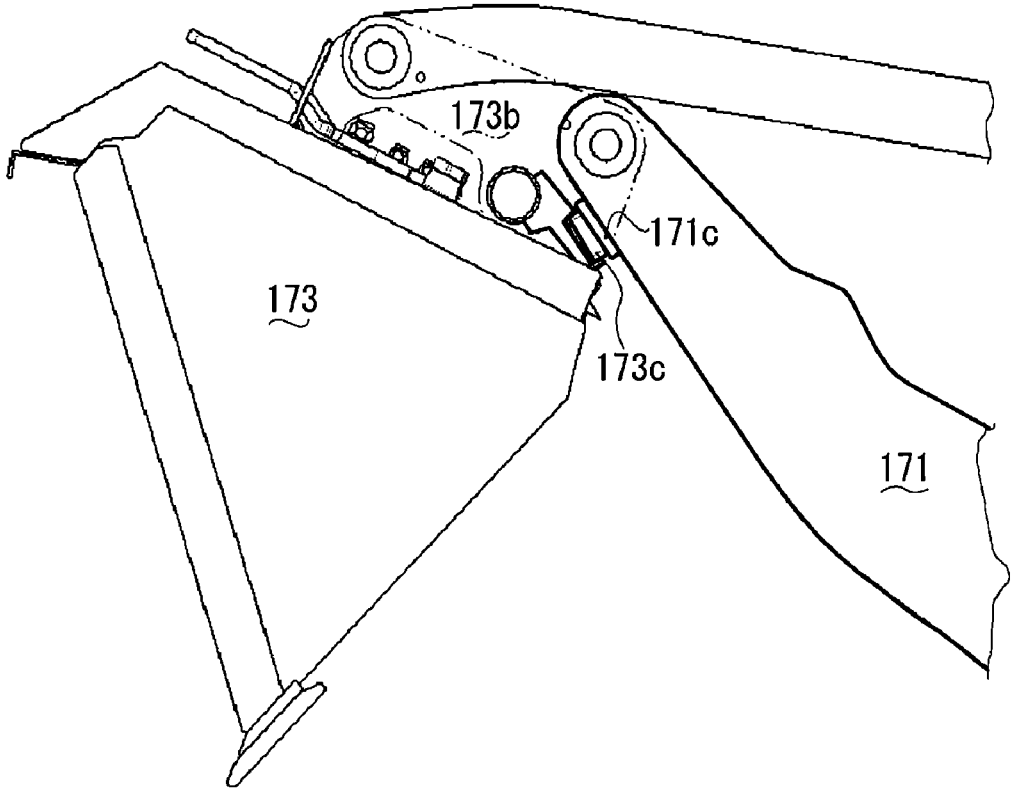
FIG. 11 is a side view illustrating another stopper when dumping.
Figure 12:
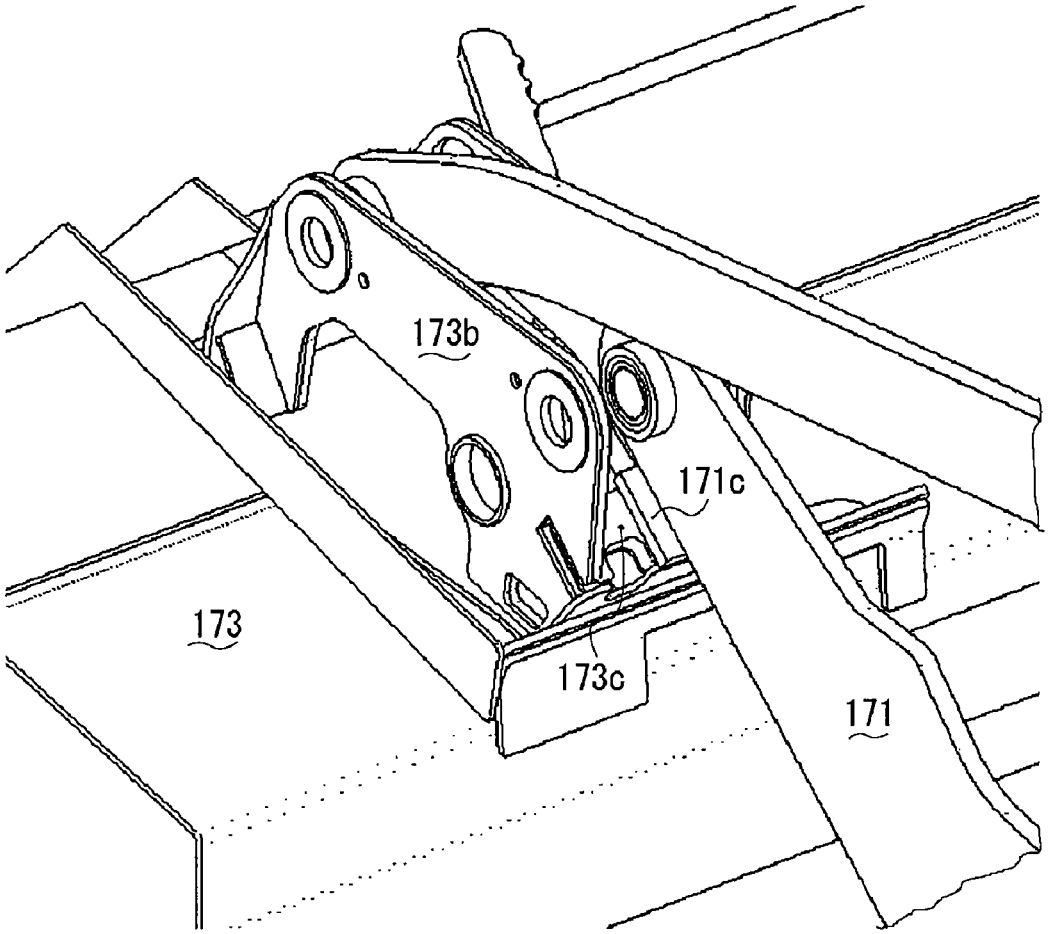
FIG. 12 is a perspective view illustrating another stopper when dumping.

It is described below referring to drawings that a construction of a stopper for the bucket 173 when dumping (when the lift arm 171 is raised and the bucket 173 is turned downward to empty load). FIG. 9 illustrates a construction of the loader when dumping. FIG. 9(*a*) is a side view illustrating the loader when dumping. FIG. 9(*b*) is an enlarged side view illustrating a stopper. FIG. 10 is a perspective view illustrating a contact situation of a stopper when dumping. FIG. 11 is a side view illustrating a second stopper when dumping. FIG. 12 is a perspective view illustrating the second stopper when dumping.

Each of the lift arms 171 is formed at a front portion thereof with a downward protrusion. Stoppers 171*b* are attached to the protrusion. The stopper 171*b* serves as a contact member that restricts a rotation of the bucket 173 when dumping.

The stoppers 171*b* are attached to both side surfaces of the protrusion provided at the bottom of the lift arm 171. The stoppers 171*b* are adapted to contact a square-bar shaped contact member 173*c* mounted on the attachment 173*b* so as to restrict the rotation of the bucket 173 when dumping. The contact member 173*c* is spanned in a bracket supporting a support pin of the attachment 173*b*. When dumping, a top flat surface of the contact member 173*c* contacts bottom flat surface of the stoppers 171*b*.

Thus, a contact area of a portion of the bucket to a portion of the lift arms is increased so as to reduce a contact pressure applied onto the contact area. As a result, the stresses applied to the lift arm 171 and the bucket 173 are decreased, and the durability of the loader 2 is improved.

Any construction can serve as a stopper for restricting the rotation of the bucket 173 when dumping only if it ensures a sufficiently large contact area on the heads of lift arms 171 to contact the bucket 173. For example, as shown in FIGS. 11 and 12, a flat plate 171*c* is provided at a lower portion of the head of the lift arm 171 so as to have a large contact area. On the lower portion of the head of the lift arm 171, the flat plate 171*c* is attached so as to face its contact surface to the contact member 173*c* provided on the attachment 173*b*. The plate 171*c* is wider than the lift arm 171. The contact area of the plate 171*c* to contact the contact member 173*c* can adjust a contact area with the contact member 173*c*. Thus, the load applied to the lift arm 171 can be decreased by such a simple construction, and the durability of the loader 2 is improved.

INDUSTRIAL APPLICABILITY

The present invention is applicable as a loading device for loading earth and sand.

The invention claimed is:

1. A loading device provided on a working machine, comprising:

right and left lift arms extended in a longitudinal direction of the working machine and bending at a longitudinally middle portion thereof, wherein each of the lift arms is formed with a lift arm cylinder support section and an intermediate link support section so as to have the bending longitudinally middle portion thereof between the lift arm cylinder support section and the intermediate link support section, and wherein each of the lift arms is formed with a cross member support section adjacent to the bending longitudinally middle portion thereof;

right and left lift arm cylinders pivotally supported at one end thereof onto the lift arm cylinder support sections of the respective lift arms so as to rotate the lift arms relative to the working machine;

a working apparatus installed on heads of the lift arms;

right and left intermediate links pivotally supported at one end thereof onto the intermediate link support sections of the respective lift arms, wherein each of the intermediate links is pivotally connected at the other end thereof to the working apparatus via another link so as to rotate the working apparatus relative to the lift arms;

a cross member connecting the lift arms to each other, wherein the cross member is inserted and fixed at ends thereof into bases, each of which is fixed on an inner surface of the cross member support section of each of the lift arms and is formed in a shape broadening from the cross member toward the corresponding lift arm; and reinforcement members, each of which is attached to an outer surface of each of the lift arms so as to overlap a part of the base and a part of the cross member when viewed in side, and is substantially V-shaped so as to be extended from the cross member support section to the lift arm cylinder support section and to the intermediate link support section, and to have a part of the bending longitudinally middle portion of the lift arm uncovered by the reinforcement member.

2. The loading device according to claim 1, wherein contact members are attached to lower side faces of heads of the respective lift arms so as to restrict rotation of the working apparatus installed on the heads of the lift arms.

3. The loading device according to claim 1, wherein at least one of the bases is partly extended toward the intermediate link support section and toward the lift arm cylinder support section.

* * * * *